United States Patent [19]

Hultquist et al.

[11] 4,168,184

[45] Sep. 18, 1979

[54] METHOD OF MAKING SURFACE LAYERS WITH IMPROVED CORROSION PROPERTIES ON ARTICLES OF IRON-CHROMIUM ALLOYS, AND A SURFACE LAYER MADE BY THE METHOD

[76] Inventors: Gunnar Hultquist, Svandammsvägen 4B, 126 32 Hägersten; Christofer Leygraf, Pilvägen 7, 130 12 Älta, both of Sweden

[21] Appl. No.: 926,822

[22] Filed: Jul. 21, 1978

[51] Int. Cl.[2] ..... C23F 7/02

[52] U.S. Cl. ..... 148/6.35; 148/31.5

[58] Field of Search ..... 148/6.35, 31.5

[56] References Cited

U.S. PATENT DOCUMENTS 2,269,601 1/1942 Perrin ..... 148/6.35

OTHER PUBLICATIONS

Hickman et a., An Electron Diffraction Study of Oxide Films Formed on High Temperature Oxidation Resistant Alloys, Electrochemical Society, Preprint 91-32, 1947, pp. 467-476.

*Primary Examiner*—Ralph S. Kendall

*Attorney, Agent, or Firm*—Stauch, Nolan, Neale, Nies & Kurz

[57] ABSTRACT

A method of making surface layers, with improved corrosion properties, on articles of iron-chromium alloys, and the article produced thereby. The article is heated in an oxygen containing gaseous atmosphere with a total vacuum of about $10^{-1}$ down to $10^{-8}$ mm Hg, preferably about $10^{-5}$ mm Hg, to a temperature, at which diffusion of the most reactive alloy component or components, primarily chromium, with respect to the tendency of combining with oxygen, to the surface becomes perceptible, at which temperature the remaining properties of the alloy substantially are maintained. For most iron-chromium alloys that temperature is between 300° C. and 600° C. The aforesaid condition of treatment, is maintained until a surface layer containing oxidized chromium has grown to a thickness of preferably $10^{-9}$ -$10^{-7}$ m, and with respect to structure and composition is transformed from a condition on the surface to a condition in the matrix of the metal alloy.

5 Claims, 1 Drawing Figure

Figure 1:
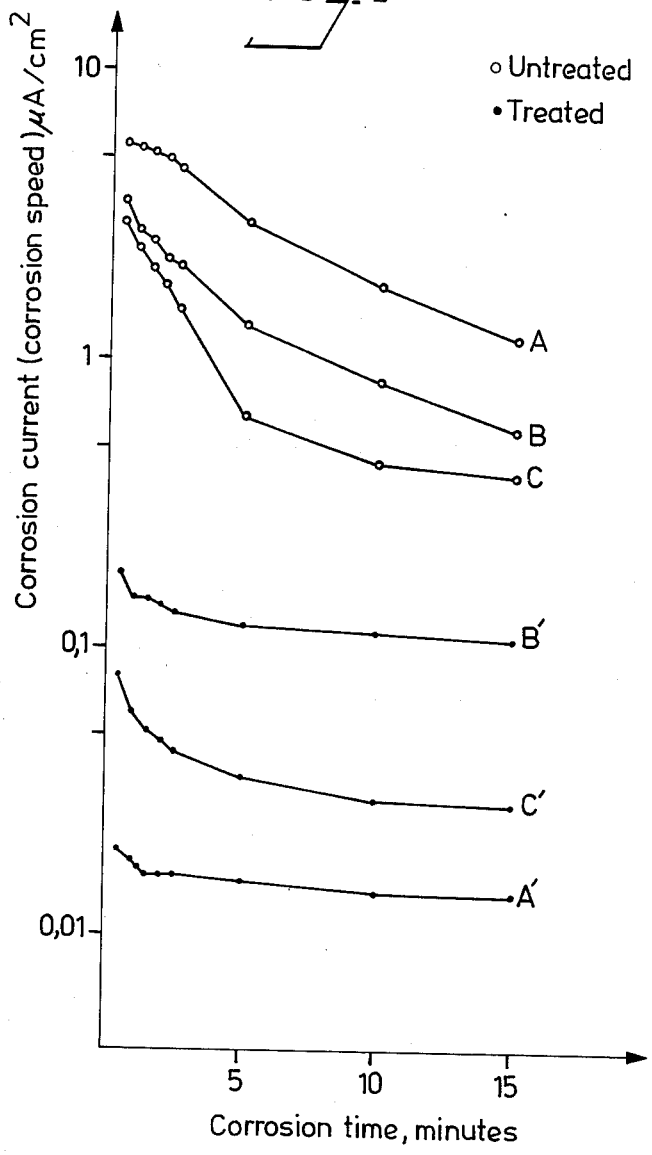

METHOD OF MAKING SURFACE LAYERS WITH IMPROVED CORROSION PROPERTIES ON ARTICLES OF IRON-CHROMIUM ALLOYS, AND A SURFACE LAYER MADE BY THE METHOD

BACKGROUND OF THE INVENTION

This invention relates to a method improving the corrosion properties of chromium-alloyed steels.

The alloying of, for example, chromium, molybdenum, silicon or aluminium into steel in order to improve the corrosion properties of the steel involves substantial manufacturing costs. The corrosion properties of a steel being determined by the condition of the steel surface, it is of interest to enrich the steel surface in respect of certain alloying components, which have a positive effect on the corrosion resistance of the steel. In this way, either the amount of alloying components in the steel matrix could be decreased in order to achieve a certain corrosion resistance, or the corrosion resistance for a given composition in the steel matrix could be increased.

For obtaining a surface layer on a substrate where the structure and composition in the surface layer differs from the substrate, one can choose between a number of known methods, for example metallization, electrolytic precipitation or cladding. The principle here is to apply the desired surface layer externally to the substrate via, for example, adsorption, condensation or precipitation on the surface of the substrate from a gaseous or liquid phase.

According to the present invention a surface layer with substantially improved corrosion properties is obtained thereby that, distinguished from the methods mentioned above, an oxide is formed on the surface of the substrate where the oxidized material is comprised in the substrate.

The present invention, thus, relates to a method of making a surface layer with improved corrosion properties on articles of iron-chromium alloys where the article is heated in an oxygen containing atmosphere with vacuum.

The invention is characterized in that the article is heated in an oxygen containing gaseous atmosphere with a total vacuum of about $10^{-1}$ down to $10^{-8}$ mm Hg, preferably about $10^{-5}$ mm Hg, to a temperature, at which diffusion of the most reactive alloying component or components, primarily chromium, with respect to its tendency of combining with oxygen, to the surface becomes perceptible, and at which temperature the remaining properties of the alloy substantially are maintained, and that the described condition for the article is maintained until a surface layer containing oxidized chromium has grown to a thickness of preferably $10^{-9}$–$16^{-7}$ m, whereby the resulting surface layer with respect to structure and composition transforms by degrees from a condition on the surface to a condition in the matrix of the metal alloy.

This invention, thus, distinguished from conventional methods where in all cases a surface layer is applied externally to a substrate, relates to a method, at which the surface layer is made by means of alloying components comprised in the substrate. The surface layer thereby is formed by heating the substrate, which is a chromium steel, in a gaseous atmosphere at vacuum containing a low and well-controlled oxygen content.

At heating in gaseous atmosphere with vacuum, a preferential enrichment to the surface of the chromium steel takes place of that alloying component or those alloying components, which have the strongest tendency of forming compounds with oxygen present on the surface of the chromium steel. The term oxygen present on the steel surface also includes the oxygen comprised in the very thin oxide film, which usually exists on the chromium steel surface prior to the heating in the gaseous atmosphere, and the small but very well controlled amount of oxygen, which exists in the gaseous atmosphere and reaches to the surface of the article.

The temperature, to which the article is heated, is chosen so that diffusion of the most reactive alloying component or components to the surface becomes perceptible. For iron-chromium alloys the diffusion takes place above a temperature of about 300° C. The temperature also must be chosen so that other properties characteristic of the metal alloy are not deteriorated. This temperature is for iron-chromium alloys below about 600° C., because above said temperature carbide is precipitated in the grain boundaries, and in certain cases phase transformations can occur. The stated lower as well as the stated higher temperature, of course, are individual for each type of iron-chromium alloy, but a suitable heating temperature for the majority of iron-chromium alloys is between 300° C. and 600° C. A preferred temperature is about 500° C. Surface layers, thus, with improved corrosion properties have been observed after heating in gaseous atmosphere in the range 300° C.–550° C., with optimum results about 475° C.

The amount of oxygen being present on the surface of the article is to be adjusted both to the heating temperature and to the desired properties of the surface layer. In many applications the oxygen amount level should be so low that substantially only one of the alloying components of the article is capable to react with oxygen. For effecting such a low supply of oxygen to the article surface, normally vacuum conditions are required, which depending on metal alloy and surface layer can extend from tenths of millimeters Hg to ultra-high vacuum conditions ($<10^{-8}$ mm Hg). The heating can in certain cases also be carried out in protective atmosphere, but then the difficulties of maintaining a sufficiently low and well-controlled oxygen level are more obvious.

For obtaining a good result, said pressure range implies a total vacuum of about $10^{-2}$–$10^{-8}$ mm Hg. A preferred pressure is about $10^{-5}$ mm Hg.

According to the invention, the article is to be treated at said pressure and temperature until a surface layer containing oxidized chromium has grown to a thickness of about $10^{-16}$–$10^{-6}$ m and preferably $10^{-9}$–$10^{-7}$ m, which, thus, is an extremely thin surface layer.

The time of such a treatment amounts to a number of hours, as is exemplified in greater detail below.

The time of heat treatment, exclusive of heating and cooling periods, is to be adjusted, of course, to the amount of oxygen in the gaseous atmosphere and to the heating temperature. It was found that this implies heating times in the range one half to ten hours, with optimum results at about three hours.

The surface layer thus obtained, with a thickness varying between $10^{-9}$ and $10^{-7}$ m, shows a structure and a composition which by degrees transforms from a condition in the outermost atom layer of the surface layer to a condition characterizing the matrix of the metal alloy.

The improved corrosion properties are attributed to an observed enrichment of alloying components, such as chromium, molybdenum or titanium in the surface layers thus formed.

As a consequence of the gradual transformation from substrate to surface layer, the surface layer is characterized by good adherence to the substrate. The transformation further takes place without great accumulations of defects or other material deficiencies. A further consequence of the fact that the surface layer is applied to the substrate internally and under vacuum conditions, is that the coat is the same all over the article surface, thus also in inward bulges and other surface areas where an external application would be rendered difficult by shading effects.

A surface layer made according to the present method on articles of iron-chromium alloys, which were heated in an oxygen containing gaseous atmosphere under low pressure, thus, comprises chromium of a higher concentration than the article in general, which chromium is oxidized entirely or partially, and which surface layer has a thickness of about $10^{-10}$–$10^{-6}$ m, preferably $10^{-9}$–$10^{-7}$ m.

EXAMPLES:

I (a) A plate of iron-chromium alloy containing 5% chromium was exposed on a surface of 20 mm$^2$ to tap water for 2 hours. After 2 hours a corrosion current of $10^{-5}$ A was obtained. (b) A plate similar to that in (a) was exposed according to the invention to a treatment consisting of heating at 475° C. for 6 hours at the total pressure $1{,}8\times10^{-5}$ mm Hg. The resulting surface layer was characterized by a gradual transformation from a high chromium content farthest outwardly in the surface layer to the low chromium content in the matrix of the alloy. When 20 mm$^2$ of this treated surface were exposed to tap water, after 2 hours a corrosion current of $10^{-7}$ A was obtained. The one hundred times lower corrosion current was corresponding also to a hundred times smaller decrease in weight.

II

Plates of iron-chromium alloys containing 10% chromium were exposed on surfaces of 20 mm$^2$ to tap water. The sample, which was exposed to a treatment according to the invention comprising heating at 480° C. for 4 hours at the total pressure $2{,}0\times10^{-5}$ mm Hg, showed after 36 hours exposure a corrosion current, which was two hundred times lower than that of untreated samples after the same exposure time.

III

Plates of iron-chromium alloys containing 17% chromium were exposed on surfaces of 20 mm$^2$ to a 4% NaCl solution in the presence of a gap. The sample, which was exposed to a treatment according to the invention comprising heating at 475° C. for 6 hours at the total pressure $1{,}8\times10^{-5}$ mm Hg showed after 11 hours exposure one single pitting, while untreated samples after the same exposure time showed pitting over the entire gap area.

In the above examples and their experimental correspondences is shown, that a preferred treatment consists of exposing the article to an oxygen containing gaseous atmosphere with a vacuum of about $3.10^{-5}$–$10^{-5}$ mm Hg at a temperature of about 500° C. for a period of about 4–6 hours.

IV

Plates of three different commercially available stainless steels were exposed on surfaces of 20 mm$^2$ at room temperature to a 3% NaCl solution in the presence of a gap. The samples, which were subjected to a treatment according to the invention comprising a heating at 475° C. for 1 hour at the total pressure $1{,}5\times10^{-5}$ mm Hg showed after 24 hours exposure corrosion currents, which for all stainless steels were significantly lower than for untreated stainless steels after the same exposure time. The differences in corrosion current for treated and, respectively, untreated samples are apparent from FIG. 1, which is the result of the exposure during the first fifteen minutes in 3% NaCl solution and compositions according to the below Table 1 of the stainless steels included in the comparison. It should be added that the corrosion currents during extended exposure tests continue to decrease with the time, but that the mutual order between different treated and untreated stainless steels is the same as after 15 minutes exposure.

The surfaces of iron-chromium alloys prior to heating in gaseous atmosphere can be subjected to some kind of treatment, such as mechanic polishing, bright annealing, pickling, electrolyte polishing or etching, or alternatively they may not be treated. In all cases, however, a very increased corrosion resistance of a material treated according to the invention is obtained.

Below examples are given which refer to bright annealed and, respectively, pickled material, while the above examples referred to mechanically ground surfaces.

V

Bright annealed plates of stainless steel SIS 2343 (as regards composition see designation B in Table 1) were exposed on surfaces of 20 mm$^2$ at room temperature to 3% neutral NaCl solution in the presence of a gap and during a simultaneous potentio-dynamic load, which in steps was increased by 50 mV per minute. The potential, at which local attacks were initiated adjacent the gap, is hereinafter called crevice corrosion potential. The samples, which were exposed to a treatment according to the invention comprising heating at 475° C. for 2 hours at a total pressure of $5\times10^{-5}$ mm Hg showed a crevice corrosion potential, which on the average was 550 mV higher than for corresponding untreated bright annealed steel samples.

VI

Pickled plates of stainless steel SIS 2333 (as regards composition, see designation D in Table I) were subjected to a similar corrosion test as described in Example V. The samples, which were subjected to a treatment according to the invention comprising heating at 475° C. for 2 hours at the total pressure of $7\times10^{-6}$ mm Hg, showed a crevice corrosion potential, which on the average was 130 mm higher than for corresponding untreated pickled steel samples.

Table I.

| Designation | Material | Chemical analysis in % by weight C | Si | Mn | Cr | Ni | Mo | Other |
|---|---|---|---|---|---|---|---|---|
| A | Cr18Mo2Ti | 0.030 | 0.34 | 0.48 | 18.4 | 0.27 | 2.27 | 0.60 Ti |
| B | SIS 2343 | 0.046 | 0.38 | 1.30 | 17.7 | 11.0 | 2.74 | |
| C | Cr18Ni25MoCu | 0.020 | 0.56 | 1.82 | 19.6 | 24.5 | 4.4 | 1.43 Cu |
| D | SIS 2333 | 0.040 | 0.47 | 1.67 | 18.8 | 9.1 | 0.53 | |

The present invention can be applied to alloys other than pure iron and chromium alloys. As iron-chromium alloys according to the present invention are understood alloys, which in addition to the basic elements iron and chromium contain one or more of the basic elements nickel, aluminium, silicon, titanium, manganese, copper or molybdenum.

The present method and article produced thereby are considered in all respects as illustrative and not restrictive, the scope of the invention being indicated by the appended claims rather than by the foregoing description, and all changes which come within the meaning and range of equivalency of the claims and therefore intended to be embraced therein.

What is claimed and desired to be secured by Letters Patent is:

1. A method of making surface layers with improved corrosion properties on articles of iron-chromium alloys, where the article is heated in an oxygen containing atmosphere with vacuum, comprising the steps of heating the article in an oxygen containing gaseous atmosphere with a total vacuum of within the range of from about $10^{-1}$ to about $10^{-8}$ mm Hg, and under a temperature, at which diffusion of the most reactive alloy component or components, primarily chromium, with respect to the tendency of combining with oxygen, to the surface becomes perceptible, and at which temperature the remaining properties of the alloy substantially are maintained, and maintaining said article under said vacuum and temperature until a surface layer containing oxidized chromium has grown to a thickness of approximately $10^{-9}$—$10^{-7}$ m, whereby the resulting surface layer with respect to structure and composition by degrees transforms from a condition on the surface to a condition in the matrix of the metal alloy.

2. A method according to claim 1 wherein the total vacuum is maintained at approximately $10^{-5}$ mm Hg.

3. A method according to claim 1, wherein the alloy is exposed to an oxygen containing gaseous atmosphere and the vacuum is about $3.10^{-5}$ -$10^{-5}$ mm Hg, the temperature is maintained at approximately 500° C. for a time within the range of approximately 4–6 hours.

4. A surface layer with improved corrosion properties on articles of iron-chromium alloys made by heating the article in an oxygen containing gaseous atmosphere under low pressure, characterized in that the surface layer comprises chromium of a higher concentration than the article in general, which chromium is oxidized entirely or partially, and the thickness of the surface layer is within the range of $10^{-10}$-$10^{-6}$ m.

5. A surface layer with improved corrosion properties on articles of iron-chromium alloys as defined in claim 4, wherein the thickness of the surface layer falls within the range of $10^{-9}$-$10^{-7}$ m.

* * * * *

UNITED STATES PATENT AND TRADEMARK OFFICE

CERTIFICATE OF CORRECTION

PATENT NO. : 4,168,184

DATED : September 18, 1979

INVENTOR(S) : Gunnar Hultquist and Christofer Leygraf

It is certified that error appears in the above-identified patent and that said Letters Patent are hereby corrected as shown below:

On the Abstract page the Claim for Priority has been omitted. Please insert:

--Foreign Application Priority Data

July 27, 1977 Sweden .....7708604--.

Column 4, line 2, "$3.10^{-5}$" should read --$3 \cdot 10^{-5}$--.

Column 6, line 22, "$3.10^{-5}$" should read --$3 \cdot 10^{-5}$--.

Signed and Sealed this

Sixteenth Day of September 1980

[SEAL]

Attest:

SIDNEY A. DIAMOND

Attesting Officer

Commissioner of Patents and Trademarks